United States Patent [19]

Slanker

[11] 4,260,502

[45] Apr. 7, 1981

[54] SYNTHETIC DRAWING AND IRONING LUBRICANT

[75] Inventor: Steven R. Slanker, Tinley Park, Ill.

[73] Assignee: Nalco Chemical Company, Oak Brook, Ill.

[21] Appl. No.: 46,348

[22] Filed: Jun. 7, 1979

[51] Int. Cl.[3] ..... C10M 1/06

[52] U.S. Cl. ..... 252/49.5; 72/42; 252/46.7; 252/47.5; 252/52 A; 252/56 R

[58] Field of Search ..... 252/46.7, 47.5, 49.5, 252/56 R, 52 A; 72/42

[56] References Cited

U.S. PATENT DOCUMENTS

| | | | |
|---|---|---|---|
| 3,285,851 | 11/1966 | Dyer | 252/49.5 X |
| 3,298,954 | 1/1967 | Brown | 252/49.5 X |
| 3,374,171 | 3/1968 | Davis | 252/49.3 X |
| 3,448,787 | 6/1969 | Beers | 252/49.5 X |
| 3,507,792 | 4/1970 | Zuraw | 252/49.5 |
| 3,835,052 | 9/1974 | McDole et al. | 252/49.5 |
| 3,855,136 | 12/1974 | McDole et al. | 252/49.5 |
| 3,857,865 | 12/1974 | Sturwold et al. | 252/49.5 X |
| 3,933,658 | 1/1976 | Beiswanger et al. | 252/49.5 X |
| 3,945,930 | 3/1976 | Sugiyama et al. | 252/49.5 X |
| 4,062,784 | 12/1977 | Baur | 252/49.5 |

FOREIGN PATENT DOCUMENTS

| | | | |
|---|---|---|---|
| 785780 | 11/1957 | United Kingdom | 252/49.5 |
| 839073 | 11/1958 | United Kingdom | 252/49.5 |
| 846839 | 8/1960 | United Kingdom | 252/49.5 |
| 899395 | 6/1962 | United Kingdom | 252/49.5 |
| 1354480 | 5/1974 | United Kingdom | 252/49.5 |

OTHER PUBLICATIONS

Bastian, "Metal Working Lubricants", 1951, pp. 76–77.

*Primary Examiner*—Andrew Metz
*Attorney, Agent, or Firm*—Richard L. Johnston

[57] ABSTRACT

A synthetic metal working lubricant characterized by an absence of mineral oil but which is water immiscible and dispersible in water to form oil-in-water emulsions in which said lubricant is in the discontinuous phase is prepared using polybutenes, also referred to as polyisobutylenes, having an average molecular weight within the range of approximately 320–610 constituting a principal ingredient in combination with polyethylene glycol mono- and/or diesters of higher carboxylic acids or mixtures of such acids containing 8 to 22 carbon atoms in an acyclic or branched carbon chain and/or higher fatty acids containing 8–22 carbon atoms together with optional corrosion inhibiting agents which are effective in inhibiting corrosion of ferrous and non-ferrous metals to which the lubricant is applied for the purpose of working such metals.

10 Claims, No Drawings

SYNTHETIC DRAWING AND IRONING LUBRICANT

BACKGROUND

The invention is particularly applicable to cupping, drawing and ironing operations in the making of metal cans, especially aluminum cans. In the manufacture of such cans, the initial operation is usually referred to as a cupping operation and involves forming the metal into a cup at pressures of 2,000–2,500 pounds per square inch gauge (psig). The metal is then redrawn to elongate the sides and afterwards it is ironed at higher pressures around 5,000 psig to increase the length of the sides and diminish the thickness.

These operations require lubrication of the metal and various types of lubricants containing mineral oil, together with fatty acids and aliphatic carboxylic acid ester emulsifying agents have heretofore been employed. Knepp, U.S. Pat. No. 3,923,671, discloses examples of such lubricants.

Davis, U.S. Pat. No. 3,374,171, discloses a cutting fluid comprising an alkanolamine, a polyoxyalkylene glycol and a saturated organic acid containing from 6 to 9 carbon atoms. According to the disclosure in this patent, however, the use of higher molecular weight saturated organic acids is to be avoided because of clogging of filters, poor rust protection and reduced tool life in areas where hard water is encountered.

BRIEF SUMMARY OF THE INVENTION

The invention provides a synthetic metal working lubricant characterized by an absence of mineral oil but which is water immiscible and dispersible in water to form oil-in-water emulsions in which said lubricant is in the discontinuous phase and is prepared using polybutenes, also referred to as polyisobutylenes, having an average molecular weight within the range of approximately 320–610 constituting a principal ingredient in combination with polyethylene glycol mono- and/or diesters of higher carboxylic acids or mixtures of such acids containing 8 to 22 carbon atoms in an acyclic or branched carbon chain and/or higher fatty acids containing 8–22 carbon atoms together with optional corrosion inhibiting agents which are effective in inhibiting corrosion of ferrous and non-ferrous metals to which the lubricant is applied for the purpose of working such metals.

DETAILED DESCRIPTION OF THE INVENTION

The polybutenes used in the practice of the invention are available commercially under designations such as AMOCO Polyisobutylenes having grade designations such as L-14, L-50, and H-25. These substances are water immiscible liquids at ordinary temperatures and have various viscosities depending upon the molecular weights. As previously indicated, the average molecular weights are normally within the range of 320–610. Thus L-14, which is in the lower molecular weight range, has a viscosity at 100° F. of 27–33 centistokes; L-50 which has a somewhat greater molecular weight has a viscosity at 100° F. within the range of 106–112 centistokes; L-100 which has a higher molecular weight has a viscosity of 210–227 centistokes at 100° F; and H-25 which has a still higher molecular weight has a viscosity of 48–59 centistokes at 210° F. Any of the aforesaid polybutenes or mixtures thereof can be employed in making the compositions of the invention. Normally, the neat material prior to emulsification in water will contain at least 20% and not more than 90% by weight of polybutene.

The remainder of the neat composition is composed of polyethylene glycol mono- and/or diesters of carboxylic acids containing 8–22 carbon atoms in a carbon chain which may be saturated or unsaturated or branched or acyclic. The polyethylene glycol portion of the molecule has a molecular weight of at least 90 and preferably 100–400. A preferred polyethylene glycol ester is Polyethylene glycol 400 dioleate. However, satisfactory results have been obtained by using polyethylene glycol esters of tall oil and polyethylene glycol esters of 2-ethylhexanoic acid as well as other mono- and diesters of carboxylic acids containing 8–22 carbon atoms both saturated and unsaturated, including specifically the esters of lauric acid, myristic acid, hexadecyl carboxylic acid and stearic acid.

In addition, long chain acids per se are preferably employed which contain 8–22 carbon atoms in a carbon chain and are either saturated or unsaturated, including the aforementioned acids employed in forming the polyethylene glycol esters and particularly oleic acid which is unsaturated and normally liquid.

The total quantity of the polyethylene glycol mono- and/or dicarboxylic acid esters and the long chain carboxylic acids should be within the range of 80–10% by weight of the neat material. The quantity of long chain carboxylic acids containing 8–22 carbon atoms can vary up to 40%. It is usually preferable to use a weight ratio of the polyethylene glycol ester to the long chain carboxylic acid within the range of 1:3 to 3:1.

In addition to the foregoing ingredients, it is normally desirable and practically essential to include in the foregoing composition a substance such as mercaptobenzothiazole(MBT) as a fraction of a percent by weight of the composition, preferably 0.02 to 0.1% by weight to inhibit corrosion such as, for example, copper corrosion in non-ferrous metals. Other optional corrosion inhibitors are those which inhibit corrosion of ferrous metals such as, for example, amyl acid phosphate which is added in the preparation of the neat material in quantities from 0% to 3% by weight, preferably around 0.5% by weight.

Another optional additive is a corrosion inhibitor to prevent vapor phase corrosion such as, for example, morpholine which is compatible with the other ingredients and is added in proportions from 0% to 3% by weight of the neat composition.

The invention will be further illustrated but is not limited by the following examples in which the quantities are given in parts by weight unless otherwise indicated.

EXAMPLE I

This example illustrates a preferred embodiment of the invention wherein the lubricant consists of the following ingredients:

| Ingredients | Percent by Weight |
|---|---|
| Polyisobutylene L-50 | 79.05 |
| Polyethylene Glycol 400 Dioleate | 15.00 |
| Oleic acid | 5.00 |
| Amyl acid phosphate | 0.50 |
| Morpholine | 0.40 |

-continued

| Ingredients | Percent by Weight |
|---|---|
| MBT | 0.05 |

The viscosity of this composition at 40° C. is 71.3 centistokes.

This composition is used in an aluminum cupping operation as a step in the formation of aluminum cans, either as a neat composition or by mixing it with water in proportions of at least 5% to form an oil-in-water emulsion. The preferred emulsion lubricant contains 20% by weight of the composition of this example and 80% water. For an ironing operation in the production of aluminum cans or other aluminum articles, the neat lubricant is mixed with water in proportions of 1–15% by weight of the total resultant emulsion, preferably around 4% by weight.

This composition, therefore, performs very well as a lubricant either in cupping operations at 2,000 to 2,500 psig or in ironing operations at 5,000 psig or more. The composition of the invention provides very satisfactory hydrodynamic lubrication on ferrous metals such as iron and steel as well as on non-ferrous metals such as aluminum.

EXAMPLE II

A lubricant composition was prepared containing the following ingredients:

| Ingredients | Percent by Weight |
|---|---|
| L-50 Polyisobutylene | 59.25 |
| Polyethylene Glycol 400 Dioleate | 15.00 |
| Methyl Oleate | 20.00 |
| Oleic acid | 3.00 |
| Triethanolamine | 2.20 |
| $C_{12}$ phosphate ester (LB-400) | 0.50 |
| MBT | 0.05 |

This example illustrates the use of different proportions of polyisobutylene and the use of a different type of ferrous metal inhibitor (the LB-400) as well as the use of triethanolamine as a vapor phase corrosion inhibitor rather than morpholine.

The resultant lubricant is employed in the same manner as described in connection with Example I.

EXAMPLE III

A lubricant composition was prepared as follows:

| Ingredients | Percent by Weight |
|---|---|
| Polyisobutylene L-50 | 69.05 |
| Triethylene glycol C8 and C10 carboxylic acid esters | 15.00 |
| Oleic acid | 5.00 |
| Soybean Oil | 2.00 |
| 4 mole ethoxylated lauryl alcohol (Brij 30) | 4.o00 |
| 9 mole ethoxylated stearic acid (Myrj 45) | 4.00 |
| Morpholine | 0.4 |
| Amyl acid phosphate | 0.5 |
| MBT | 0.05 |

This composition is used in the same manner as described in Example I and illustrates the employment of other emulsifying ingredients.

In a similar manner other polyisobutylenes can be employed including L-14, L-100, H-25 and mixtures thereof.

The compositions of the invention are unique synthetic lubricants specifically useful for manufacturing two-piece aluminum cans. These lubricants offer complementary lubrication for both cupping and ironing. They are especially desirable from the standpoint that they contain no mineral oil which is environmentally undesirable. They also provide reduced cleaning costs. In addition they have an approximately neutral pH (3% solution in water has a pH of 7.0–7.5). When employed in cupping operations they are advantageously used at concentrations of 20–30% by weight emulsified with water and as body makers at concentrations of 3–5% by weight emulsified with water. The synthetic chemistry of the composition lends itself to improved cleaning and improved effluent treatment.

From the examples given to illustrate the invention it will be noted that the lubricant compositions can contain additional substances such as soybean oil, which is illustrative of a class of vegetable oils including corn oil, safflower oil, cottonseed oil and other oils consisting essentially of glycerides of long chain fatty acids. If such oils are added to the lubricant composition they are usually employed in amounts within the range of 0.5–10% by weight of the total composition. It is also possible to add lower esters of long chain fatty acids having 8–20 carbon atoms of which methyloleate is illustrative. This class of esters includes methyl, ethyl, propyl, isopropyl and up to and including 7 carbon atom esters of the long chain carboxylic acids previously mentioned containing 8–22 carbon atoms which may be saturated or unsaturated. Such lower aliphatic esters of long chain carboxylated acids can be employed in amounts within the range of 0.5–30% by weight of the total composition.

In addition, emulsifying agents such as ethoxylated higher alcohols containing 8–22 carbon atoms and ethoxylated long chain carboxylic acids containing 8–22 carbon atoms can be employed as illustrated by the 4 mole ethoxylated lauryl alcohol and the 9 mole ethoxylated stearic acid in Example III. These are usually employed in amounts within the range of 0.5–10% by weight of the total composition.

The invention is hereby claimed as follows:

1. A synthetic metal working lubricant characterized by an absence of mineral oil but which is water immiscible and dispersible in water to form oil-in-water emulsions in which said lubricant is in the discontinuous phase, said lubricant consisting essentially of:
   - A. 20–90% by weight polyisobutylenes having an average molecular weight within the range of approximately 310–610;
   - B. 80–10% by weight of emulsifying agent (a) polyethylene glycol mono- and diesters of carboxylic acids containing 8–22 carbon atoms in a carbon chain, and (b) carboxylic acids containing 8–22 carbon atoms in a carbon chain, the ratio of (a):(b) being within the range of 1:3 to 3:1.

2. A synthetic metal working lubricant characterized by an absence of mineral oil which is water miscible and dispersible in water to form oil-in-water emulsions in which said lubricant is in the discontinuous phase, said lubricant consisting essentially of:
   - A. 20–90% polyisobutylenes having an average molecular weight of approximately 310–610;
   - B. emulsifying agents which are polyethylene glycol mono- and diesters of carboxylic acids containing 8–22 carbon atoms in a carbon chain;

C. carboxylic acids containing 8–22 carbon atoms in a carbon chain; and one or more of the following optional ingredients:

D. lower esters of long chain carboxylic acids containing 8–22 carbon atoms and up to and including 7 carbon atoms in the ester group;

E. oily glycerides of long chain fatty acids;

F. ethoxylated higher alcohols containing 8–22 carbon atoms;

G. ethoxylated long chain carboxylic acids containing 8–22 carbon atoms; and

H. corrosion inhibitors for ferrous and non-ferrous metals, the total quantity of B and C being within the range of 80–10% by weight, the quantity of C being up to 40% by weight; the quantity of D being within the range of 0.5–30% by weight, the quantity of E being within the range of 0.5–10% by weight; the quantity of F being within the range of 0.5–10% by weight; the quantity of G being within the range of 0.5–10% by weight, and the quantity of H being within the range of a fraction of a percent to 3% by weight.

3. A composition as claimed in claims 1 or 2 emulsified in water to form an oil-in-water emulsion.

4. A composition as claimed in claims 1 or 2 in which the polyisobutylene has a viscosity at 100° F. within the range of 106–112 centistokes.

5. A composition as claimed in claims 1 or 2 in which the ingredient (a) of B is polyethylene glycol 400 dioleate and the ingredient (b) of B is oleic acid.

6. A composition as claimed in claim 2 consisting essentially of approximately 79% by weight of polyisobutylene having a viscosity at 100° F. within the range of 106–112 centistokes, approximately 15% of polyethylene glycol 400 dioleate, approximately 5% oleic acid, approximately 0.5% by weight amyl acid phosphate, approximately 0.4% by weight morpholine and approximately 0.05% by weight mercaptobenzothiazole.

7. A composition as claimed in claim 2 in which the ingredients are polyisobutylenes, polyethylene glycol 400 dioleate, methyloleate, oleic acid, triethanolamine, C12 phosphate ester and mercaptobenzothiazole.

8. A composition as claimed in claim 3 in which the ingredients are polyisobutylenes, triethylene glycol C8 and C12 carboxylic acid esters, oleic acid, soybean oil, 4 mole ethoxylated lauryl alcohol, 9 mole ethoxylated stearic acid, morpholine, amyl acid phosphate and mercaptobenzothiazole.

9. A method of working non-ferrous and ferrous metals which comprises applying as a lubricant a composition as claimed in claim 3.

10. A method of working aluminum which comprises applying as a lubricant a composition as claimed in claim 3.

* * * * *

UNITED STATES PATENT AND TRADEMARK OFFICE

CERTIFICATE OF CORRECTION

PATENT NO. : 4,260,502

DATED : April 7, 1981

INVENTOR(S) : Steven R. Slanker

It is certified that error appears in the above-identified patent and that said Letters Patent are hereby corrected as shown below:

Column 3, Example III, under "Percent by Weight", item 5, "4.o00" should read --4.00--.

Signed and Sealed this

*Thirtieth* Day of *June 1981*

[SEAL]

*Attest:*

RENE D. TEGTMEYER

*Attesting Officer*

*Acting Commissioner of Patents and Trademarks*